US011498193B2

(12) United States Patent
Del Rossa

(10) Patent No.: US 11,498,193 B2
(45) Date of Patent: Nov. 15, 2022

(54) WHEEL HUB BEARING EXTRACTION TOOL

(71) Applicant: Jeffrey Del Rossa, Pittsburgh, PA (US)

(72) Inventor: Jeffrey Del Rossa, Pittsburgh, PA (US)

( * ) Notice: Subject to any disclaimer, the term of this patent is extended or adjusted under 35 U.S.C. 154(b) by 0 days.

(21) Appl. No.: 15/929,819

(22) Filed: May 22, 2020

(65) Prior Publication Data

US 2020/0376637 A1 Dec. 3, 2020

Related U.S. Application Data

(60) Provisional application No. 62/854,531, filed on May 30, 2019.

(51) Int. Cl.
*B25B 27/14* (2006.01)
*B25B 27/00* (2006.01)

(52) U.S. Cl.
CPC ..... *B25B 27/14* (2013.01); *B25B 27/0035* (2013.01)

(58) Field of Classification Search
CPC ..... Y10T 29/53552; Y10T 29/53596; Y10T 29/53657; Y10T 29/53848; Y10T 29/53857; Y10T 29/53865; B25B 27/0028; B25B 27/0035; B25B 27/023; B25B 27/062; B25B 27/14
USPC ..... 29/426.5, 263, 258, 238, 239, 255, 252, 29/278, 244
See application file for complete search history.

(56) References Cited

U.S. PATENT DOCUMENTS 4,642,866 A * 2/1987 Murtaugh ..... B25B 27/062 29/259
6,502,293 B1 * 1/2003 Khurana ..... B25B 27/02 29/426.5
7,296,330 B2 * 11/2007 Bergman ..... B25B 27/0035 29/254
8,931,156 B1 * 1/2015 Zimmer ..... F16H 55/36 29/426.1

* cited by examiner

*Primary Examiner* — Lee D Wilson
*Assistant Examiner* — Alberto Saenz
(74) *Attorney, Agent, or Firm* — Buchanan Ingersoll & Rooney PC

(57) ABSTRACT

Disclosed is an extraction tool including a top plate having a top plate force rod hole and a plurality of top plate push rod holes. The extraction tool includes a bottom plate having a bottom plate force rod hole, a plurality of bottom plate push rod holes, and a plurality of bottom plate bolt holes. The tool includes a force rod configured to slidably engage the top plate force rod hole and threadingly engage the bottom plate force rod hole. The tool includes a plurality of push rods, each push rod configured to threadingly engage a top plate push rod hole and slidably engage a bottom plate bolt hole. The bottom plate is attached to the hub bearing assembly and rotating the force rod will advance the bottom plate and the hub bearing assembly towards the top plate, thereby extracting the hub bearing from a knuckle.

15 Claims, 14 Drawing Sheets

WHEEL HUB BEARING EXTRACTION TOOL

CROSS-REFERENCE TO RELATED APPLICATIONS

This application is related to and claims the benefit or U.S. provisional application no. 62/854,531, filed on May 30, 2019, the entire contents of which is incorporated herein by reference.

FIELD OF THE INVENTION

The present invention generally relates to an apparatus for extracting a wheel hub bearing assembly on a car, truck, or other vehicle.

BACKGROUND OF THE INVENTION

Wheels on vehicles (such as cars or trucks) are generally coupled to an engine through a drive shaft (which can be alternatively referred to as an axle or spindle). More particularly, the wheel rims on the wheels are connected to a hub bearing assembly through a series of bolts, and the hub bearing assembly is mounted or bolted onto a steering knuckle that allows the wheel to move in relation to the drive shaft while still being engaged with the drive shaft. One exemplary drawing of this configuration is shown FIG. 1, but those skilled in the art would recognize that there are other variations on this theme used in vehicles.

The hub bearing assembly is generally comprised of (1) a central bearing, (2) a metal plate connected to one side of the bearing that contains a series of holes (5 or more) uniformly spaced from the center of the plate to which the wheel rim is bolted via lug nut bolts that pass through the holes, (3) a geared-tooth hole through the center of the metal plate and bearing that is designed to engage a geared-tooth fixture on the end of the drive shaft, and (4) another metal mounting plate that is connected to the other side of the bearing that is used to mount the hub bearing assembly to the knuckle.

On occasion, the hub bearing assembly will need to be removed from the drive shaft in order to effectuate repairs on the car or to replace various components (including the hub bearing assembly itself). To remove the hub bearing assembly, one typically removes the wheel by removing the lug nuts that attach the wheel rim to the hub bearing assembly. After the wheel is removed, the bolts connecting the hub bearing assembly to the knuckle are also removed. Additionally, any other connections between the car and the hub bearing assembly are also removed (e.g., sensor cables, etc.). In theory, the hub bearing assembly should now slide off of the drive shaft.

In actuality, the hub bearing assembly is often stuck onto the drive shaft because the hub bearing assembly is not perfectly sealed and is exposed to the environment (including, water, oil, dirt, and other liquid and solid contaminants). This exposure can cause corrosion, degradation, or interference that prevents the hub bearing assembly from easily being removed.

In order to remove the hub bearing assembly in these instances, various undesirable methods have to be employed. For instance, one can use a hammer to strike the backside of the hub bearing assembly in an effort to knock it free or loose. Another alternative is to use a pry bar to try to leverage apart the hub bearing assembly from the drive shaft. Yet another alternative is to attach a tool to one of the lug nut bolts in an effort to pull the hub bearing assembly off of the drive shaft or to create another surface that can be struck by a hammer. All of these methods have their deficiencies in that they attempt to remove the bearing housing assembly from the knuckle at an angle vs perpendicular, e.g., the method it was originally installed.

The hub bearing assembly is a precision machined component that is supposed to seamlessly mesh with the drive shaft with the bearing pressed into the seat machined into the wheel assembly knuckle. Using a hammer or other device to strike the hub bearing assembly or any existing removal tool risks damaging the assembly or the drive shaft or at least compromising these components or their connection. Similarly, using a pry bar risks damaging these components or their connection.

Another deficiency is that all of these methods work by providing a torque on one side of hub bearing assembly, which causes the hub bearing assembly to rotate perpendicular with respect to the drive shaft. Due to the precision fit between the bearing and knuckle, this rotation loads the wheel hub unequally and makes removal attempts unsuccessful or problematic. For example, this rotation is undesirable because it can damage either the drive shaft or the hub bearing assembly (or both) or cause the hub bearing assembly to become jammed onto the drive shaft and bearing knuckle. Moreover, these traditional methods of removing a wheel hub bearing assembly can sometimes take hours to complete requiring completely removing the wheel knuckle assembly and using a hydraulic press to remove the wheel bearing housing. Once removed and a new bearing assembly installed, a suspension alignment is required. Additional time may also be required if the hub bearing assembly is also stuck to the drive shaft.

Therefore, there is a need for a tool and method of removing a hub bearing assembly in reverse of the way it was installed originally. The tool and method reduces the risk of damaging either the hub bearing assembly or drive shaft (or both) in a quicker fashion.

SUMMARY OF THE INVENTION

The disclosed invention overcomes some of the limitations of the prior art by providing a tool that uniformly pushes the hub bearing assembly off of the drive shaft without rotating the hub bearing assembly with respect to the drive shaft.

In particular, one embodiment of the present invention utilizes a top plate that engages the knuckle and provides a rigid and stable platform through which a force rod passing through the center of the top plate and aligned along the central axis of the drive shaft engages a bottom plate that is attached to the hub bearing assembly. By rotating the force rod, the bottom plate is drawn towards the top plate, which, in turn, pushes the hub bearing assembly away from the drive shaft. Because the force rod and the drive shaft are aligned on the same axis, the hub bearing assembly does not rotate relative to the drive shaft as it is removed from the drive shaft.

In an exemplary embodiment, an extraction tool includes: a top plate having a top plate force rod hole and a plurality of top plate push rod holes; a bottom plate having a bottom plate force rod hole, a plurality of bottom plate push rod holes, and a plurality of bottom plate bolt holes; a force rod configured to slidably engage the top plate force rod hole and threadingly engage the bottom plate force rod hole; and a plurality of push rods, each push rod configured to threadingly engage a top plate push rod hole and slidably engage a bottom plate bolt hole. Any one or combination of the bottom plate bolt holes align with any one or combination of lug nut holes of a hub bearing assembly when the bottom plate is placed over the hub bearing assembly.

In some embodiments, bottom plate has a plurality of set screw holes.

In some embodiments, the tool includes a plurality of set screws.

In some embodiments, any one or combination of the bottom plate bolt holes are configured to slidably receive a lug nut bolt.

In some embodiments, the tool includes a nut to threadingly engage the lug nut bolt.

In some embodiments, the tool includes a bolt, wherein any one or combination of the bottom plate bolt holes are configured to slidably receive the bolt.

In some embodiments, the tool includes a nut to threadingly engage the bolt.

In some embodiments, any one or combination of the bottom plate push rod holes align with any one or combination of lug nut holes of the hub bearing assembly when the bottom plate is placed over the hub bearing assembly.

In some embodiments, an individual push rod is configured to pass through an individual bottom plate push rod hole and an individual lug nut hole of the hub bearing assembly.

In some embodiments, the individual push rod is configured to abut against a knuckle.

In some embodiments, the bottom plate further includes a collar.

In some embodiments, the bottom plate further includes a recess.

In an exemplary embodiment, an extraction tool includes: a top plate configured to slidably receive a force rod and threadingly receive a plurality of push rods; a bottom plate configured to threadingly receive the force rod and slidably receive the plurality of push rods, the bottom plate further configured to attach to a top surface of a hub bearing assembly. When the bottom plate is placed over the hub bearing assembly and the top plate is placed over the bottom plate, the plurality of push rods pass through lug nut holes formed in the hub bearing assembly and abut against a knuckle located on a bottom surface of the hub bearing assembly. When the force rod is rotated, the bottom plate advances towards the top plate and draws the hub bearing assembly away from the knuckle.

In an exemplary embodiment, a method of extracting a hub bearing assembly from a knuckle involves: placing a bottom plate against a top surface of a hub bearing assembly; securing the bottom plate to the hub bearing assembly; threadingly securing a plurality of push rods to a top plate; placing the top plate over the bottom plate so that the plurality of push rods pass through the bottom plate, pass through the hub bearing assembly, and abut against a knuckle; sliding a force rod though the top plate and threadingly engaging the force rod with the bottom plate; and rotating the force rod to advance the bottom plate and the hub bearing assembly towards the top plate.

In some embodiments, the method further involves adjusting the plurality of push rods to adjust the orientation of the top plate relative to the bottom plate.

In some embodiments, adjusting the plurality of push rods causes the top plate to be parallel with the bottom plate.

In some embodiments, the method further involves adjusting set screws within the bottom plate to adjust the orientation of the bottom plate relative to the hub bearing assembly.

In some embodiments, adjusting the set screws within the bottom plate causes the bottom plate to be parallel with a top surface of the hub bearing assembly.

DETAILED DESCRIPTION OF THE INVENTION

Figure 1:
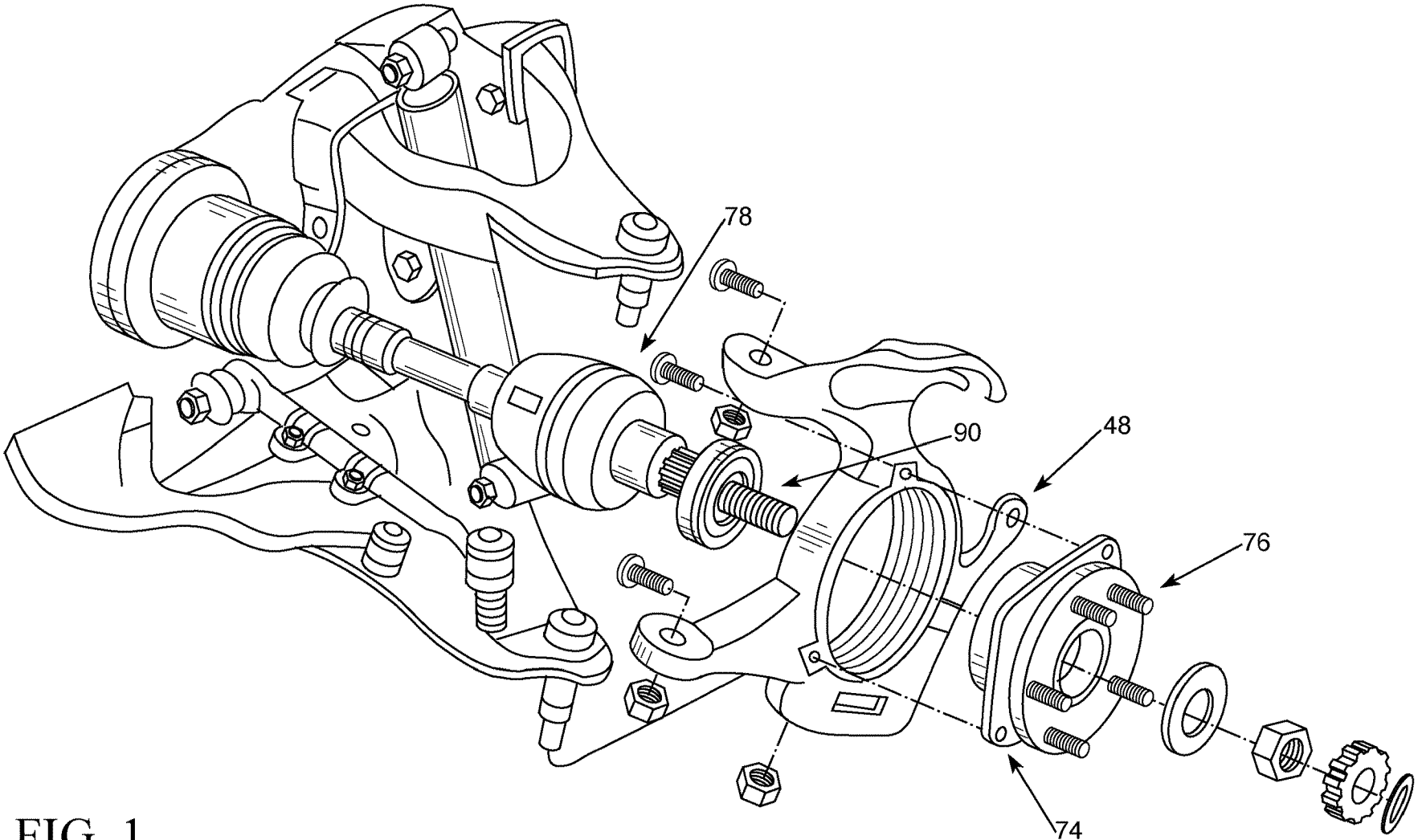
FIG. 1 is an exploded view of an exemplary drive shaft, steering knuckle, and hub bearing assembly.
Figure 2:
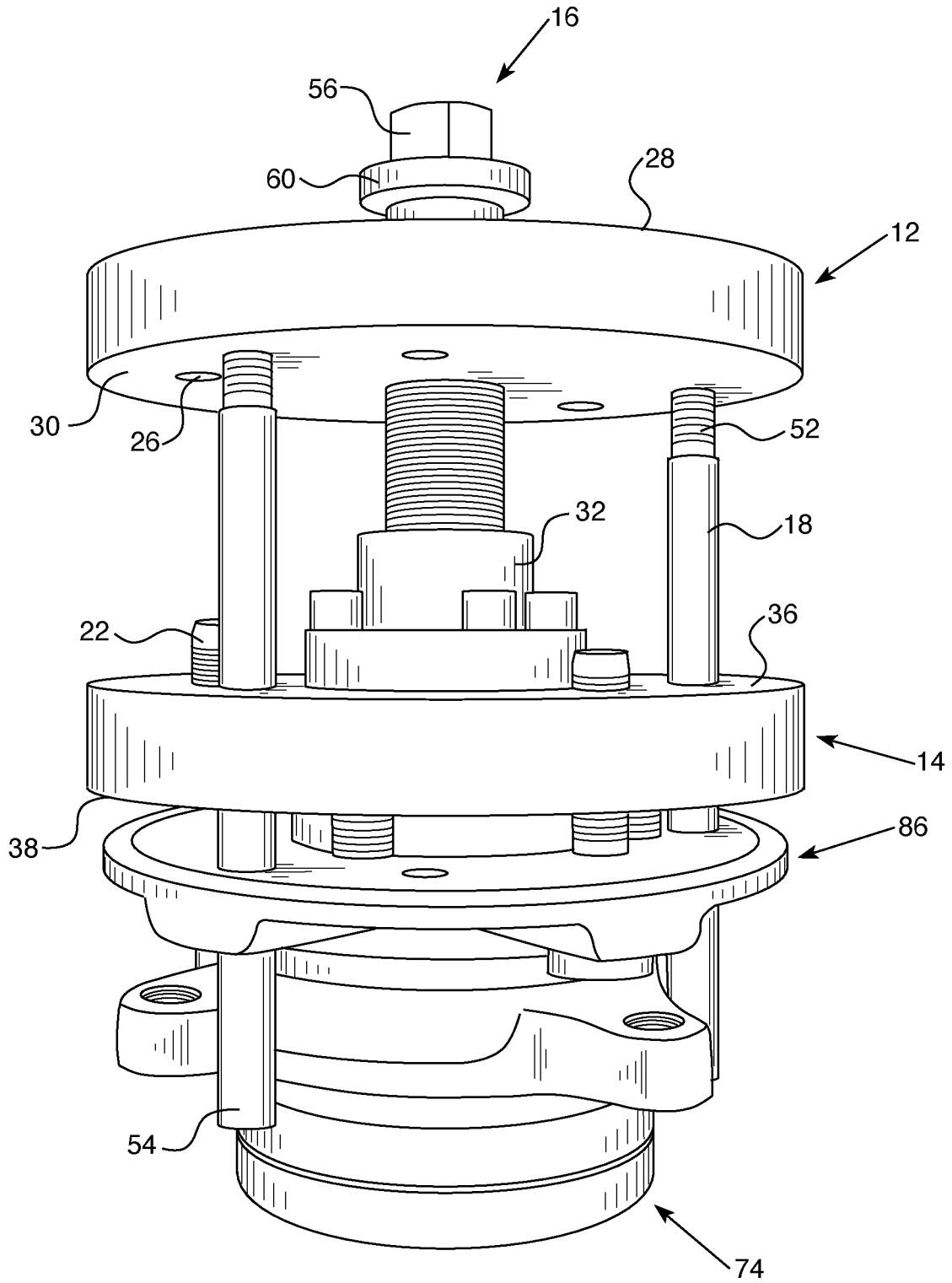
FIG. 2 is a side view of an exemplary embodiment of the extraction tool inserted into a hub bearing assembly.

Referring to FIG. 1, a typical arrangement for a drive shaft 78 includes a hub bearing assembly 74 coupled to a knuckle 48, the knuckle 48 being coupled to the drive shaft 78. Embodiments of the extraction tool 10 include a top plate 12, a bottom plate 14, a force rod 16, and a plurality of push rods 18. In operation, the bottom plate 14 is placed against the hub bearing assembly 74. A plurality of push rods 18 are connected (via threaded engagement) with the top plate 12. The top plate 12 is then placed over the bottom plate 14 so that the push rods 18 slidably insert through bottom plate push rod holes 50, pass through bolt holes 80 of the hub bearing assembly 74, and abut against the knuckle 48. A force rod 16 is slidably inserted through a top plate force rod hole 24 and connected to a bottom plate force rod hole 40 (via a threaded engagement). As will be explained later, additional setting procedures may be performed to ensure proper alignment of the component parts and connection of the bottom plate 14 to the hub bearing assembly 74. The force rod 16 is then rotated to cause the bottom plate 14 to advance towards the top plate 12, the top plate 12 being held stationary during the rotation due to the push rods' 18 abutment to the knuckle 48 acting as a mechanical stop. The bottom plate 14, being connected to the hub bearing assembly 74, will draw the hub bearing assembly 74 with it so as to pull the hub bearing assembly 74 away from the knuckle 48 as the bottom plate 14 advances toward the top plate 12.

One embodiment of the present invention is described below. As shown in FIGS. 2-7, extraction tool 10 is comprised of a top plate 12, a bottom plate 14, a force rod 16, a plurality of push rods 18 (e.g., three push rods 18), a plurality of set screws 20 (e.g., five set screws 20), and a plurality of bolts 22 (e.g., two bolts 22). The number of push rods 18, set screws 20, and bolts 22 are exemplary, and one skilled in the art would understand that any number of these components can be used to meet desired design criteria.

The top plate 12 is a rigid planar member (e.g., a disc, a plate, a panel, etc.) having a flat top plate upper side 28 and a flat top plate lower side 30. The cross-sectional shape of the top plate 12 can be circular, oblong, oval, square, triangular, etc. It is contemplated for the top plate 12 to be a circular disc shaped member. The top plate 12 has a top plate force rod hole 24. The top plate force rod hole 24 is a smooth bored hole that extends through the top plate 12 (e.g., extends from the top plate upper side 28 to the top plate lower side 30). The smooth bore of the top plate force rod hole 24 is configured to slidingly receive a force rod 16. It is contemplated for the top plate force rod hole 24 to be located a central location of the top plate 12. The top plate 12 also includes at least one top plate push rod hole 26. For example, the top plate 12 can have a plurality of top plate push rod holes 26, each extending through the top plate 12 (e.g., extends from the top plate upper side 28 to the top plate lower side 30). Each top plate push rod hole 26 is threaded so as to threadenly engage with a threaded portion of a push rod 18. Each top plate push rod hole 26 is located at a position on the top plate 12 that is radially outward from the central location of the top plate 12. Each top plate push rod hole 26 can be located along a circumferential path so as to be formed at a different location of the top plate 12 but each is a same radial distance from the central location of the top plate 12. However, each top plate push rod hole 26 need not be on the same circumferential path, and thus any number or combination of top plate push rod holes 26 can be on a first circumferential path, whereas any number or combination top plate push rod holes 26 can be on a second circumferential path.

Figure 8:
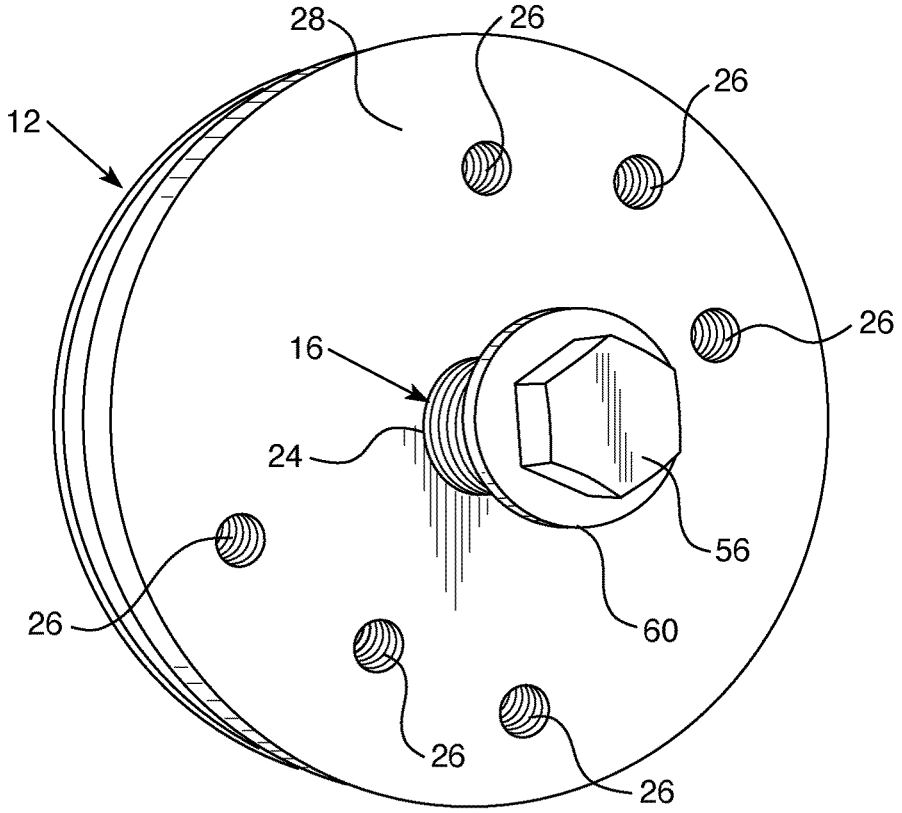
FIG. 8 is a top view of an exemplary embodiment of an extraction tool showing the top plate and a force rod partially inserted therein.
Figure 9:
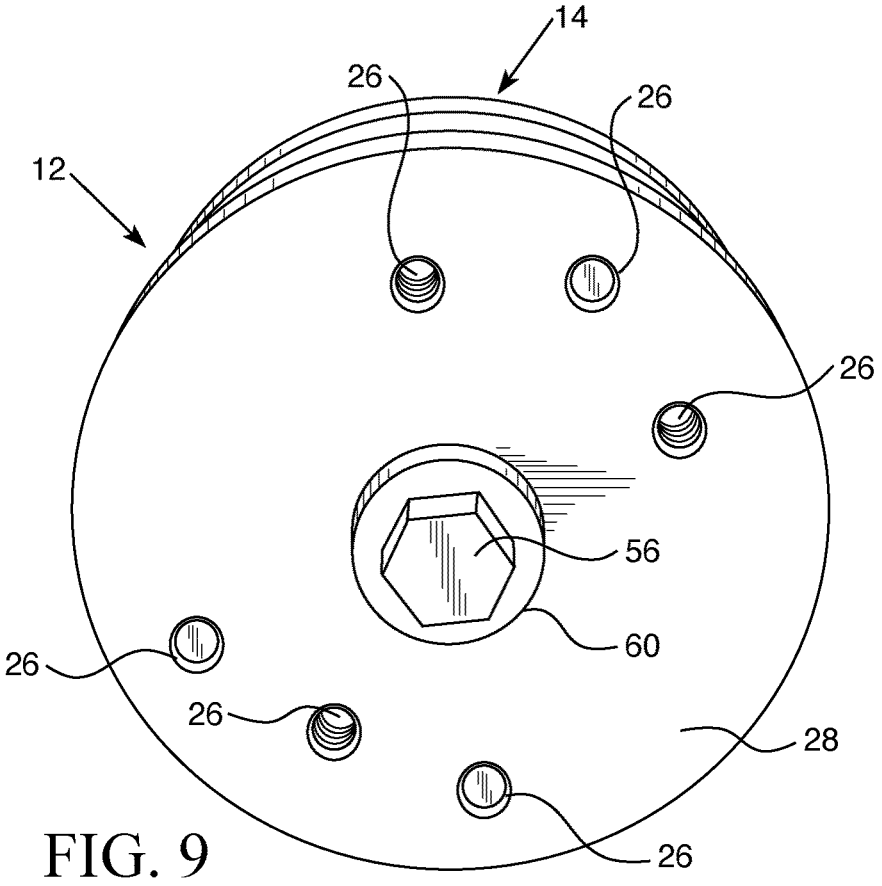
FIG. 9 is a top view of an exemplary embodiment of an extraction tool showing the top plate and a force rod inserted therein.
Figure 10:
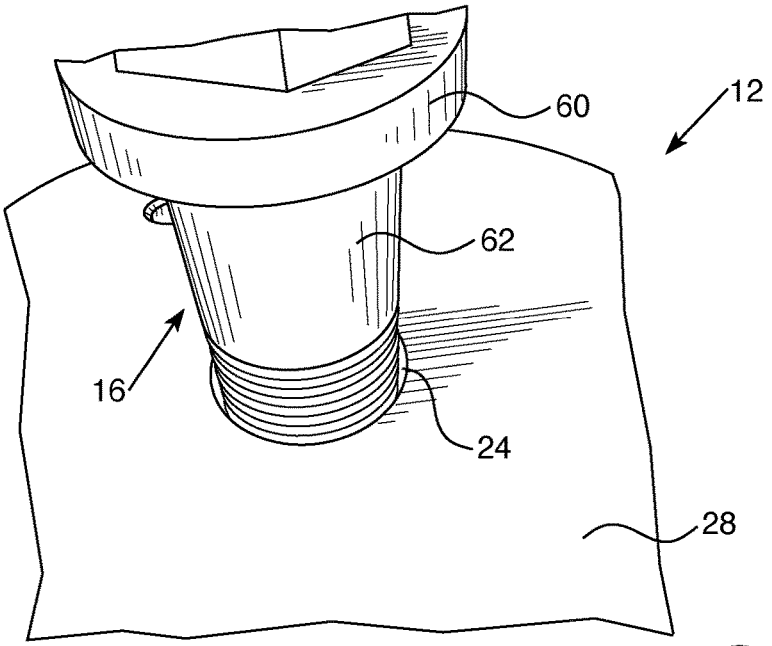
FIG. 10 is a close-up perspective view of an exemplary embodiment of a force rod partially inserted through a top plate.
Figure 11:
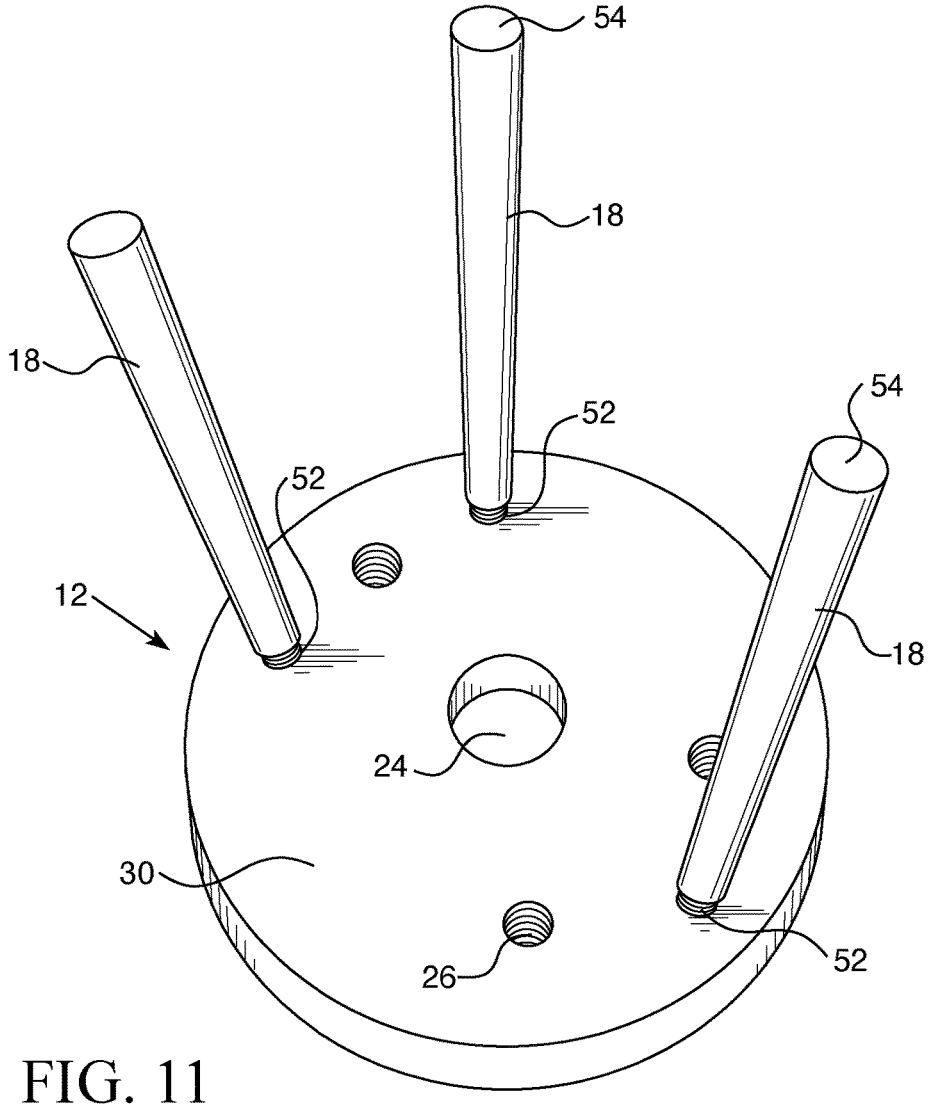
FIG. 11 is a bottom perspective view of an exemplary embodiment of top plate and three push rods.

FIGS. 8 and 11 show an exemplary top plate 12 configuration. As can be seen in FIGS. 8 and 11, the top plate 12 is a 0.5 inch thick by 6 inch diameter metal plate (e.g., stainless steel, aluminum, or the like) with a 1.15 inch diameter top plate force rod hole 24 at the center and at least one top plate push rod hole 26 (threaded) towards the edge of top plate 12. The top plate force rod hole 24 is not threaded, but is has a smooth bore. The top plate push rod holes 26 are threaded with 0.375 inch threads and are located approximately 2 inched from the center of plate 12. One embodiment of the top plate 12 has six top plate push rod holes 26, but other numbers and locations of top plate push rod holes 26 can be used (greater or less) and fall within the scope of the invention. Top plate 12 has a top plate upper side 28 and a top plate lower side 30. The top plate upper side 28 view is shown in FIG. 8, while the top plate lower side 30 view is shown in FIG. 11. FIGS. 9 and 10 show other views of top plate upper side 28.

The bottom plate 14 is a rigid planar member (e.g., a disc, a plate, a panel, etc.) having a flat bottom plate upper side 36 and a flat bottom plate lower side 38. The cross-sectional shape of the bottom plate 14 can be circular, oblong, oval, square, triangular, etc. It is contemplated for the bottom plate 14 to be a circular disc shaped member. The bottom plate 14 has a bottom plate force rod hole 40. The bottom plate force rod hole 40 is a threaded hole that extends through the bottom plate 14 (e.g., extends from the bottom plate upper side 36 to the bottom plate lower side 36). The threaded hole is configured to threadingly engage with a threaded portion of the force rod 16—as will be explained herein, the force rod 16 is inserted through the smooth bore of the top plate force rod hole 24 and threadingly engages with the threads of the bottom plate force rod hole 40. It is contemplated for the bottom plate force rod hole 40 to be located a central location of the bottom plate 14, or at least be in a location such that top plate force rod hole 24 and the bottom plate force rod hole 40 are aligned or co-axial during use of the extraction tool 10 so that the force rod 24 can be inserted into both of the top plate force rod hole 24 and the bottom plate force rod hole 40.

The bottom plate 14 also includes at least one bottom plate push rod hole 50. For example, the bottom plate 14 can have a plurality of bottom plate push rod holes 50, each extending through the bottom plate 12 (e.g., extends from the bottom plate upper side 36 to the bottom plate lower side 38). Each bottom plate push rod hole 50 is smooth bored so as to slidingly receive a smooth portion of a push rod 18. Each bottom plate push rod hole 50 is located at a position on the bottom plate 14 that is radially outward from the central location of the bottom plate 14. Each bottom plate push rod hole 50 can be located along a circumferential path so as to be formed at a different location of the bottom plate 14 but each is a same radial distance from the central location of the bottom plate 14. However, each bottom plate push rod hole 50 need not be on the same circumferential path, and thus any number or combination of bottom plate push rod holes 50 can be on a first circumferential path, whereas any number or combination bottom plate push rod holes 50 can be on a second circumferential path. It is contemplated for the bottom plate push rod holes 50 to be located such that top plate push rod holes 26 and the bottom plate push rod holes 50 are aligned or co-axial during use of the extraction tool 10 so that a push rods 18 can be inserted into both of a top plate push rod hole 26 and a bottom plate push rod hole 50. It is further contemplated for the bottom plate push rod holes 50 to be located on the bottom plate 14 such that the holes 50 align with lug nut holes 80 formed in the hub bearing assembly 74 when the bottom plate 14 is placed on the hub bearing assembly 74. This will allow for the push rods 18 to be inserted through the bottom plate push rod holes 50 and through the lug nut holes 80 formed in the hub bearing assembly 74, facilitating the push rods 18 being pushed through the hub bearing assembly 74 and being abutted against the knuckle 48.

The bottom plate 14 also includes at least one bottom plate bolt hole 50'. For example, the bottom plate 14 can have a plurality of bottom plate bolt holes 50', each extending through the bottom plate 12 (e.g., extends from the bottom plate upper side 36 to the bottom plate lower side 38). Each bottom plate bolt hole 50' is smooth bored so as to slidingly receive a bolt 22 or a lug nut bolt 76—as will be explained later these will facilitate connecting the bottom plate 14 to the hub bearing assembly 74. Each bottom plate bolt hole 50' is located at a position on the bottom plate 14 that is radially outward from the central location of the bottom plate 14. Each bottom plate bolt hole 50' can be located along a circumferential path so as to be formed at a different location of the bottom plate 14 but each is a same radial distance from the central location of the bottom plate 14. However, each bottom plate bolt hole 50' need not be on the same circumferential path, and thus any number or combination of bottom plate bolt holes 50' can be on a first circumferential path, whereas any number or combination bottom plate bolt holes 50' can be on a second circumferential path. It is contemplated for the bottom plate bolt holes 50' to be located on the bottom plate 14 such that the holes 50' align with lug nut holes 80 formed in the hub bearing assembly 74 when the bottom plate 14 is placed on the hub bearing assembly 74. This will allow for bolts 22 to be inserted through the bottom plate bolt holes 50' and threaded into the lug nut holes 80 formed in the hub bearing assembly 74 or allow the lug nut bolts 76 already threaded into the lug nut holes 80 to extend through the bottom plate bolt holes 50' when the bottom plate 14 is placed on the hub bearing assembly 74.

The bottom plate 14 also includes at least one bottom plate set screw hole 42. For example, the bottom plate 14 can have a plurality of bottom plate set screw holes 42, each extending through the bottom plate 12 (e.g., extends from the bottom plate upper side 36 to the bottom plate lower side 38). Each bottom plate set screw hole 42 is threaded so as to threadingly engage with a threaded set screw 20—as will be explained herein, the set screws 20 can be used to ensure that the bottom plate 14 is at a desired orientation (e.g., parallel with) with respect to the hub bearing assembly 74. Each bottom plate set screw hole 42 is located at a position on the bottom plate 14 that is radially outward from the central location of the bottom plate 14. Each bottom plate set screw hole 42 can be located along a circumferential path so as to be formed at a different location of the bottom plate 14 but each is a same radial distance from the central location of the bottom plate 14. However, each bottom plate set screw hole 42 need not be on the same circumferential path, and thus any number or combination of bottom plate set screw hole 42 can be on a first circumferential path, whereas any number or combination bottom plate set screw hole 42 can be on a second circumferential path.

The bottom plate 14 also includes a collar 32 formed on a portion thereof. For instance, the bottom plate upper side 36 can have a collar 32 formed thereon. The collar 32 is a riser or a raised annular formation extending upward and outward from the bottom plate upper side 36. The collar 32 is formed about or around the bottom plate force rod hole 40 (e.g., the collar envelopes or surrounds the bottom plate force rod hole 40). The inner surface of the collar 32 can be threaded, the threading of the collar 32 matching the threading of the bottom plate force rod hole 40. Thus, the threaded portion of the force rod 16 can also threadingly engage with the collar 32.

The bottom plate 14 also includes a recess 72 formed on a portion thereof. For instance, the bottom plate lower side 38 can have a recess 72 formed therein. The recess 72 is a depression or beveled formation extending inward on the bottom plate lower side 38. The recess 72 is formed about or around the bottom plate force rod hole 40 (e.g., the recess envelopes or surrounds the bottom plate force rod hole 40). As will be explained herein, the recess 72 is used to engage (e.g., mechanically fit) with a collar 84 of the hub bearing assembly 74 so as to provide support and proper alignment.

Figure 12:
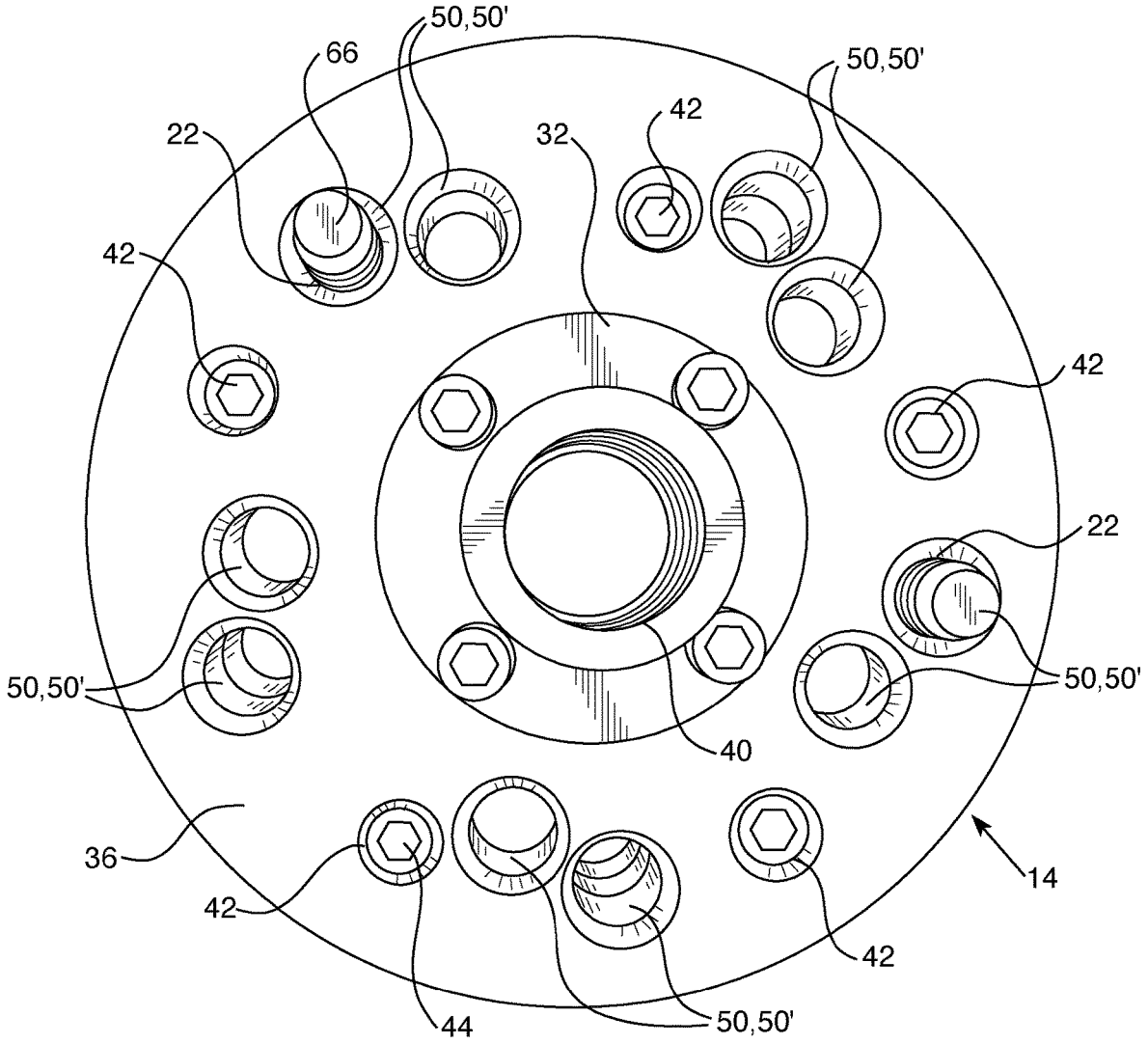
FIG. 12 is a top view of an exemplary embodiment of a bottom plate.
Figure 13:
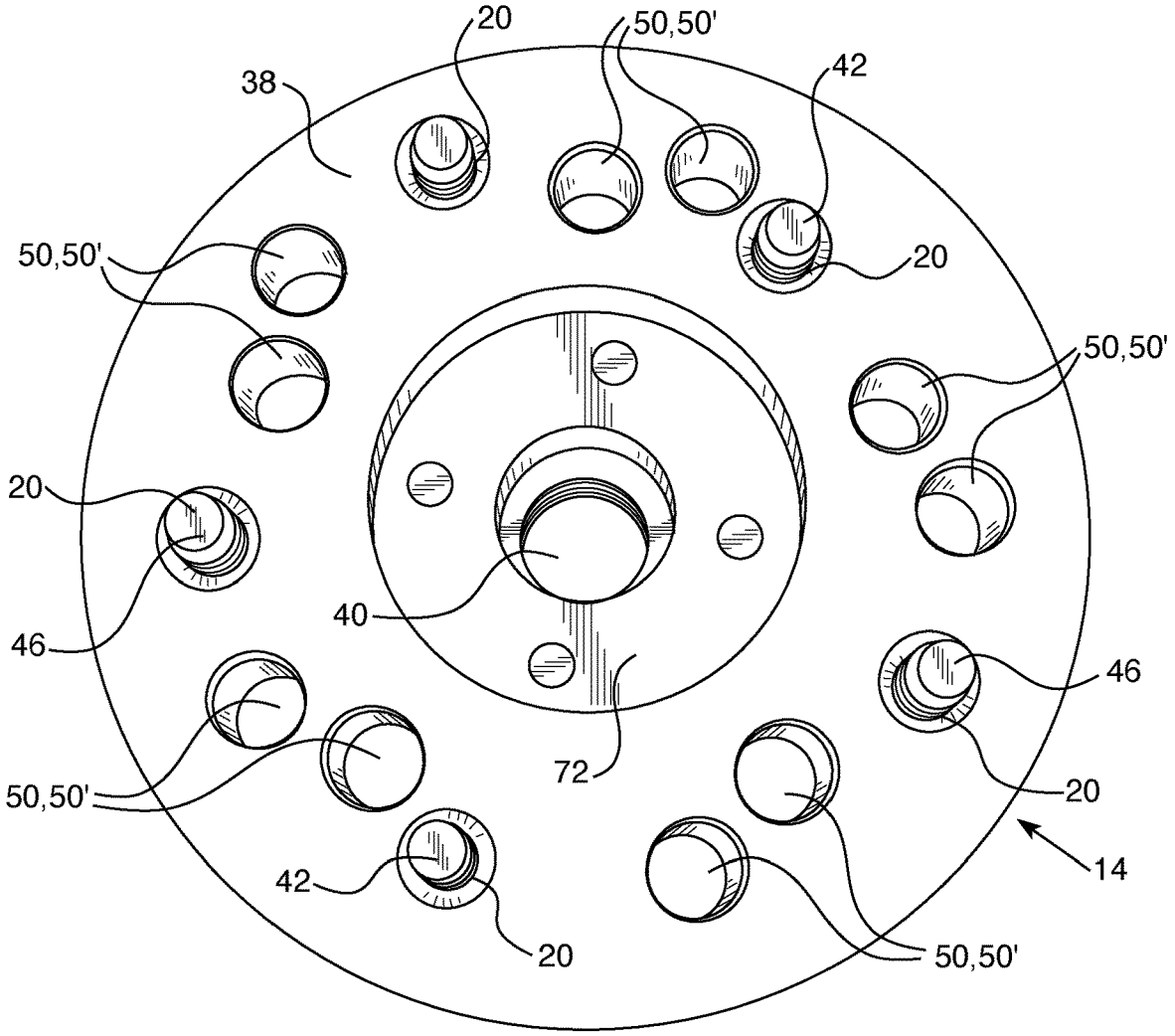
FIG. 13 is a bottom view of an exemplary embodiment of a bottom plate.

FIGS. 12 and 13 show an exemplary bottom plate 14 configuration. As shown in FIGS. 12 and 13, bottom plate 14 is a 0.5 inch thick by 6 inch diameter metal plate (e.g., stainless steel, aluminum, or the like) with bottom plate collar 32 at the center, at least one bottom plate set screw hole 42, and at least one bottom plate push rod hole 50. The bottom plate set screw holes 42 and the bottom plate push rod holes 50 are located towards the outer edge of bottom plate 14 and at various distances from the center of bottom plate 14. The bottom plate 14 has a bottom plate upper side 36 and a bottom plate lower side 38. As shown in FIG. 12, the bottom plate 14 includes a bottom plate force rod hole 40. The bottom plate force rod hole 40 is threaded. Bottom plate collar 32 assists the functionality of device 10 by structurally reinforcing the center of bottom plate 14 and providing a greater threaded length for the bottom plate force rod hole 40. The bottom plate collar 32 extends approximately 1.4 inches from top side 36 of bottom plate 14.

As shown in FIG. 13, the bottom plate lower side 38 further contains a circular recessed portion 72 that is approximately 2.5 inches in diameter and 0.7 inches deep and is centered about the center of bottom plate 14.

The bottom plate 14 further contains five 0.375 inch threaded holes as the set screw holes 42 that are evenly spaced both from the center of bottom plate 14 and along the circumference of bottom plate 14. Each set screw hole 42 can be configured to receive a set screw 20. Each set screw 20 has 0.375 inch threads and is approximately 0.6 inches long. Each set screw 20 has a head 44 and an end 46. It is contemplated for the head 44 of each set screw 20 to contain a socket for accepting a tool, such as an Allen wrench, screwdriver, or the like. It is contemplated for the end 46 of each set screw 20 to be flat for engaging (e.g., abutting against) the knuckle 48. During operation, any one or combination of set screws 20 is inserted into its respective set screw hole 42 such that the head 44 is facing the bottom plate upper side 36 and the end 46 is facing the bottom plate lower side 38. Adjustment of the set screw(s) 20 cause the set screw(s) 20 to advance towards or away from the knuckle 48, thereby causing the bottom plate 14, or at least a portion of the bottom plate 14 located at the position of the set screw 20, to advance towards or away from the hub bearing assembly 74. This can facilitate making the bottom plate 14 be at a desired orientation with respect to the hub bearing assembly 74. The desired orientation may be for the bottom plate 14 to be parallel, or substantially parallel, with the hub bearing assembly 74 (e.g., the bottom plate lower side 38 is parallel with the top surface of the hub bearing assembly 74).

Bottom plate 14 further contains ten 0.5 inch diameter holes 50, 50' that are spaced around the edge of bottom plate 14 and are approximately 4.5-5 inches from the center of bottom plate 14. These holes 50, 50' include bottom plate push rod holes 50 configured to receive the push rods, and bottom plate bolt holes 50' configured to receive bolts 22 and/or lug nut bolts 76.

The extraction tool 10 can include at least one push rod 18. Each push rod 18 is an elongated rigid member (e.g., bar, rod, billet, etc.) and can be fabricated from stainless steel, aluminum, or the like. Each push rod 18 can have a cross-sectional shape that is circular, square, hexagonal, etc. It is contemplated for each push rod 18 to have a circular cross-sectional shape and have a diameter that allows it to engage the top plate push rod hole 26 and bottom plate push rod hoe 50, as described herein. Each push rod 18 has a push rod first end 52 and a push rod second end 54. The push rod first end 52 is threaded so as to threadingly engage a top plate push rod hole 26 (note that if the push rod 18 has a cross-sectional shape that is not circular, the push rod first end 52 would still be circular in cross-sectional shape so as to facilitate the threaded engagement with the top plate push rod hole 26). The push rod second end 54 is not threaded and is contemplated to have a flat terminus so as to slidingly engage with the bottom plate push rod hole 50 and abut against the knuckle 48. In operation, each push rod 18 is threadingly engage with the top plate 12 so that the push rod first ends 52 are threaded into the top plate push rod hole 26 at the top plate lower side 30. Thus, each push rod 18, once threaded into the top plate push rod hole 26, extends from the top plate lower side 30 with its push rod second end 54 exposed to slidingly engage the bottom plate push rod hole 50 when the top plate 12 is placed over the bottom plate 14. Each push rod 18 will slide into the bottom plate push rod hole 50 via the bottom plate upper side 36, extend through the bottom plate lower side 38 (the bottom plate lower side 38 resting against the top side 86 of the hub and bearing assembly 74), extend though the bolt holes 80 of the hub bearing assembly 74, and abut against the knuckle 48.

FIG. 11 shows an exemplary push rod 18 configuration. As shown in FIG. 11, three push rods 18 screw into the top plate push rod hole 26 on the lower side 30 of the top plate 12. The push rods 18 are approximately 6 inches in length and 0.375 inch in diameter with a threaded end 52 and a flat end 54. The threaded end 52 is threaded with 0.375 inch threads. Note that the tolerance of the top plate push rod holes 26 is such that threaded ends 52 loosely fit into the threaded top plate push rod holes 26 to allow the push rods 18 to slightly move within threaded holes 26 (e.g., less than 5 degrees). This loose tolerance allows push rods 18 to more easily align and pass through the bottom plate push rod holes 50 in bottom plate 14 and to engage knuckle 48.

The extraction tool 10 can include a force rod 16. The force rod 16 is an elongated rigid member (e.g., bar, rod, billet, etc.) and can be fabricated from stainless steel aluminum, or the like. The force rod 16 can have a cross-sectional shape that is circular, square, hexagonal, etc. It is contemplated for the force rod 16 to have a circular cross-sectional shape and have a diameter that allows it to engage the top plate force rod hole 24 and bottom plate force rod hole 40, as described herein. The force rod 16 has a force rod first end 58 and a force rod second end 56. The force rod first end 58 is threaded so as to threadingly engage a bottom plate force rod hole 40 (note that if the force rod 16 has a cross-sectional shape that is not circular, the force rod first end 58 would still be circular in cross-sectional shape so as to facilitate the threaded engagement with the bottom plate force rod hole 40). The force rod second end 56 is not threaded and is contemplated to have a hexagonal or other type of head so as to facilitate being torqued by a tool (e.g., a socket or a wrench). In operation, the force rod 16 is slid through the top plate force rod hole 24 so that the force rod first end 58 spearheads the insertion by entering the top plate force rod hole 24 via the top plate upper side 28, extend through the top plate lower side 30, and engage the bottom plate force rod hole 40 at the bottom plate upper side 36. As noted herein, the bottom plate 14 can have a collar 32 formed on the bottom plate upper side 36, and thus the force rod first end 58 would threadingly engage the collar 32 before engaging the bottom plate force rod hole 40. During operation, the bottom plate 14 is placed over the hub bearing assembly 74 with the bottom plate lower side facing the hub bearing assembly 74. The top plate 12 (with the push rods 18 attached thereto) are placed over the bottom plate 14 with the top plate lower side 30 facing towards the bottom plate upper side 36 and such that the push rods 18 slide through the bottom plate push rod holes 50 and the lug nut holes 80 of the hub bearing assembly 74 and abut against the knuckle 48. The force rod 16 is slid into the top plate force rod hole 24 and threadingly engaged with the bottom plate force rod hole 40. As will be explained later, the bottom plate will have already been attached to the hub bearing assembly 74. In this configuration, the top plate is held stationary by the push rods 18 abutting the knuckle 48 so that when the force rod 16 is rotated further, the bottom plate 14 advances towards the top plate 12. The bottom plate 14, being attached to the hub bearing assembly 74, pulls or draws the hub bearing assembly 74 along with it.

Figure 14:
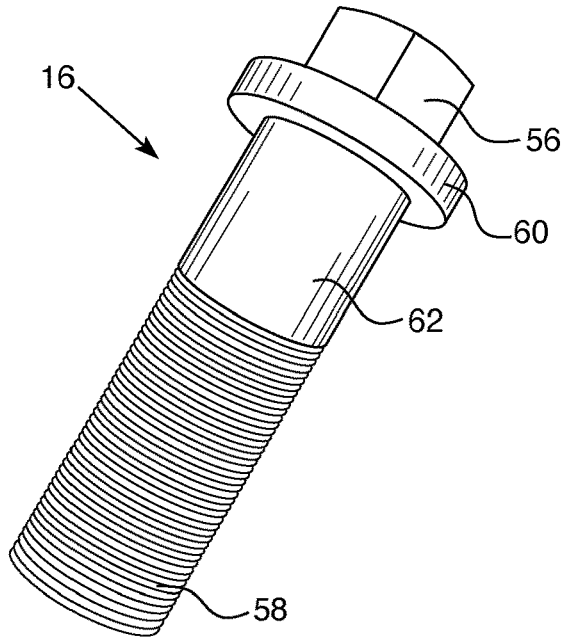
FIG. 14 is a side view of an exemplary embodiment of a force rod.

FIG. 14 shows an exemplary force rod 16 configuration. As shown in FIG. 14, the force rod 16 has an approximately 1.125 inch diameter shank 62, and the force rod 16 is approximately 3.5 inches long. The force rod 16 has a head end 56, which is in one embodiment a hexagonal head designed to be engaged by a wrench, but could be designed to be engaged by an Allen wrench or other type of tool (e.g., socketed, slotted, square shaped, etc.). The opposite end 58 of the force rod 16 is threaded with 1.0 inch threads. The force rod 16 passes through the top plate force rod hole 24 in top plate 12 and threads into the bottom plate force rod 40 in the bottom plate collar 32 on the bottom plate 14. The head end 56 of the force rod bolt 16, in addition to having a component designed to be engaged by various tools, has an approximately 1.5 inch force bolt collar 60 that is of a larger diameter than the top plate force rod hole 24 so that the head end 56 of the force rod 16 cannot pass through the top plate force rod hole 24 in top plate 12.

The threads on a standard bolt typically have a thread engagement between 60-75%. In order to increase the efficiency of the force transfer, the force rod 16 and the bottom plate force rod hole 40 can be designed for a thread engagement between 85-90%. In addition, it has been found that 1.125 inch threads provide an optimal balance between providing sufficient force to extract hub bearing assembly 74 but not too much force as to be difficult to turn the force rod 16. Other thread pitches and thread engagements could still be used and fall within the scope of the invention, however.

As shown in FIG. 10, it is contemplated for the top plate force rod hole 24 to be sized such that it is slightly larger than the shank 62 of the force rod 16, but smaller than the force rod bolt collar 60. In this way, the head end 56 engages the top plate upper side 28 and cannot pass entirely through top plate 12. Because the top plate force rod hole 24 is slightly larger than the shank 62, it allows some flexibility and accommodation for the force rod bolt 16 to align with the bottom plate force rod hole 40.

During operation, the bottom plate 14 is placed over the hub bearing assembly 74 with the bottom plate lower side facing the hub bearing assembly 74. When placed over the hub bearing assembly 74, the bottom plate bolt holes 50' are aligned with the bolt holes 80 of the hub bearing assembly 74—the bolt holes 80 being holes designed to receive lug nut bolts 74. Thus, the bottom plate bolt holes 50' are aligned to slide over the lug nut bolts 74 that are in place, or the lug nut bolts 74 can be removed and replaced with bolts 22. As will be described herein, the use of bolts 22 instead of the lug nut bolts 76 can be done to provide more effective operation.

Figure 3:
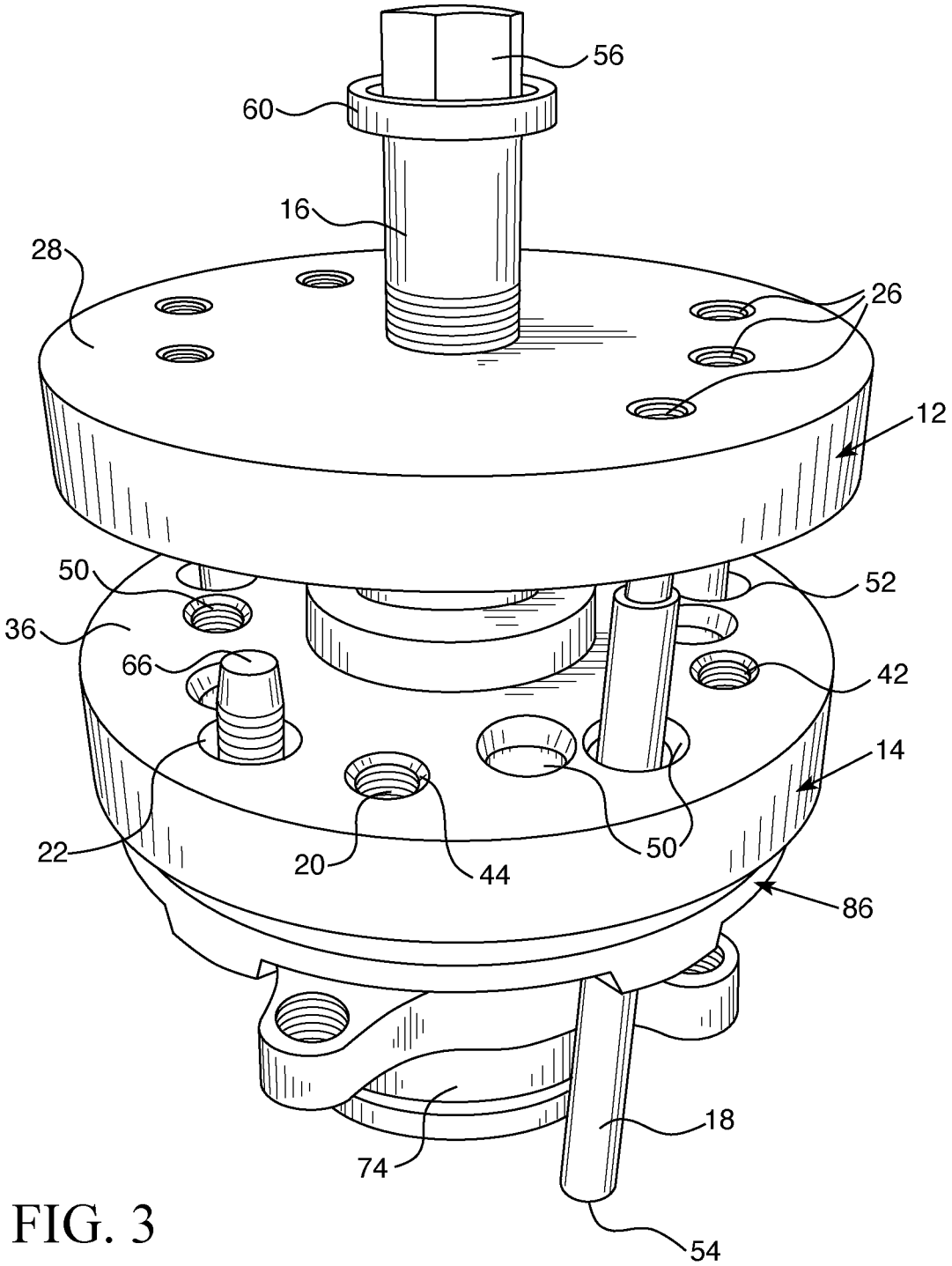
FIG. 3 is a top perspective view of exemplary embodiment of the extraction tool inserted into a hub bearing assembly.
Figure 4:
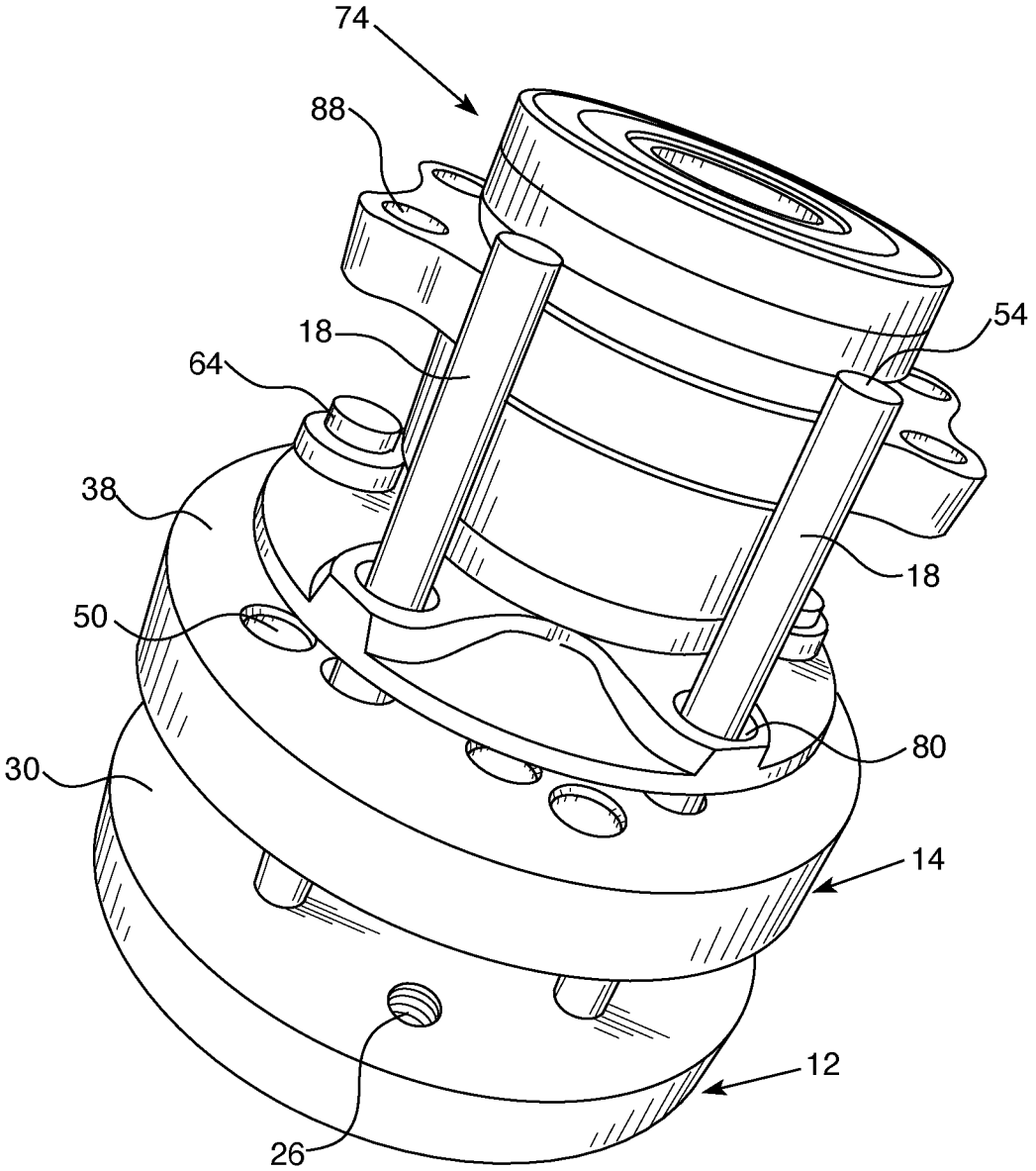
FIG. 4 is a bottom perspective view of an exemplary embodiment of the extraction tool inserted into a hub bearing assembly.
Figure 17:
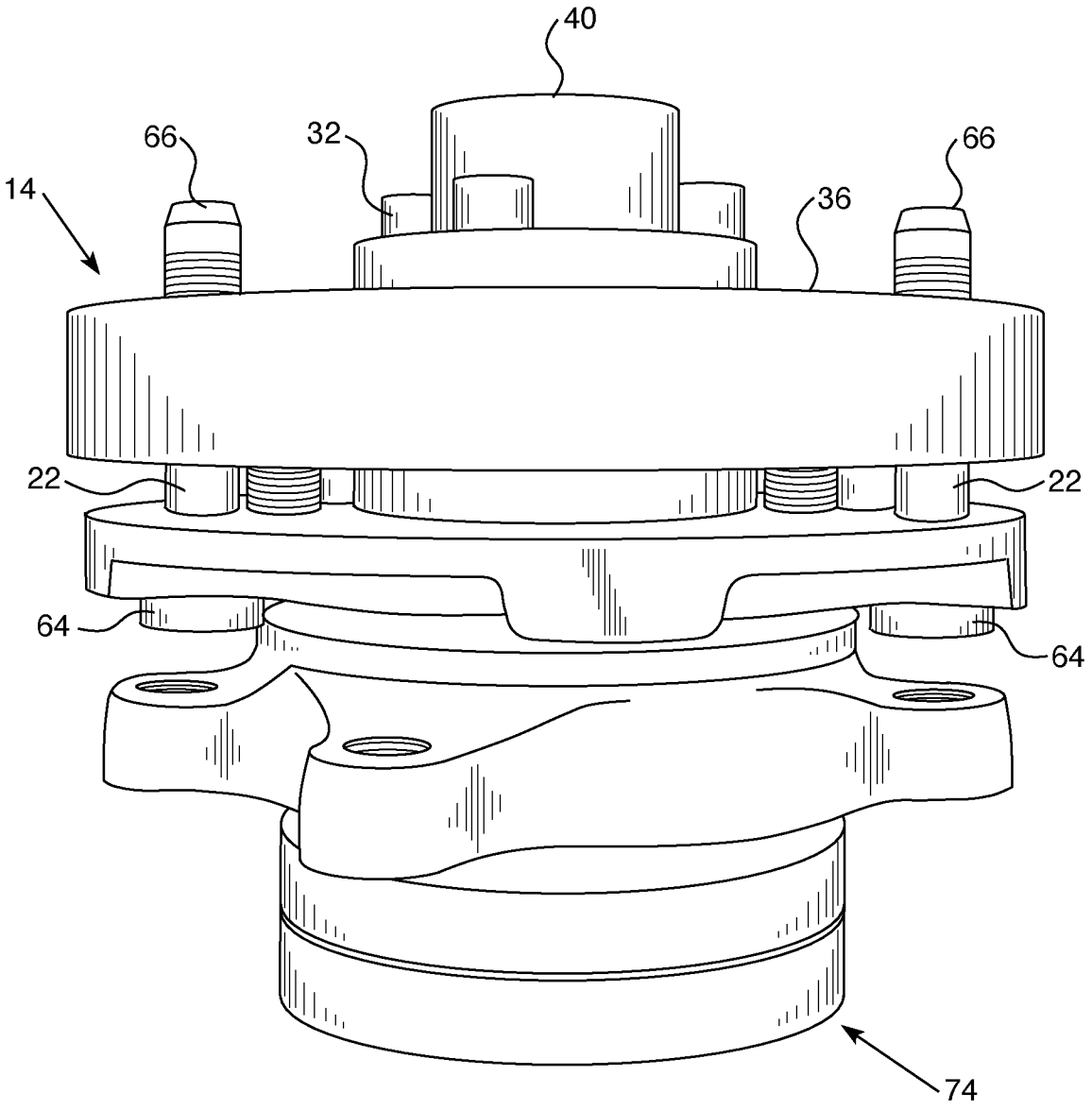
FIG. 17 is a side view of an exemplary embodiment of a bottom plate inserted onto a hub bearing assembly.

Bolts 22 are approximately 0.475 inch in diameter and 2.25 inches long, with a head end 64 and a tip end 66. As shown in FIGS. 3 and 17, at least one bolt 22 is passed through the bottom plate bolt hole 50'. It is contemplated for at least two bolts 22 or lug nut bolts 74 to be used during operation of the extraction tool 10, but more or less can be used. After the bottom plate 14 is placed over the hub bearing assembly 74 so that the bolts 22 or lug nut bolts 76 are slid through the bottom plate bolt holes 50' and emerge from the bottom plate upper side 36, nuts are screwed onto the bolts 22 or lug nut bolts 74 and tightened to firmly so as to rigidly connect the bottom plate 14 to the hub bearing assembly 74. When using the bolts 22, the head end 64 is positioned on the bottom plate lower side 38, and the tip end 66 is positioned on the bottom plate upper side 36.

Figure 15:
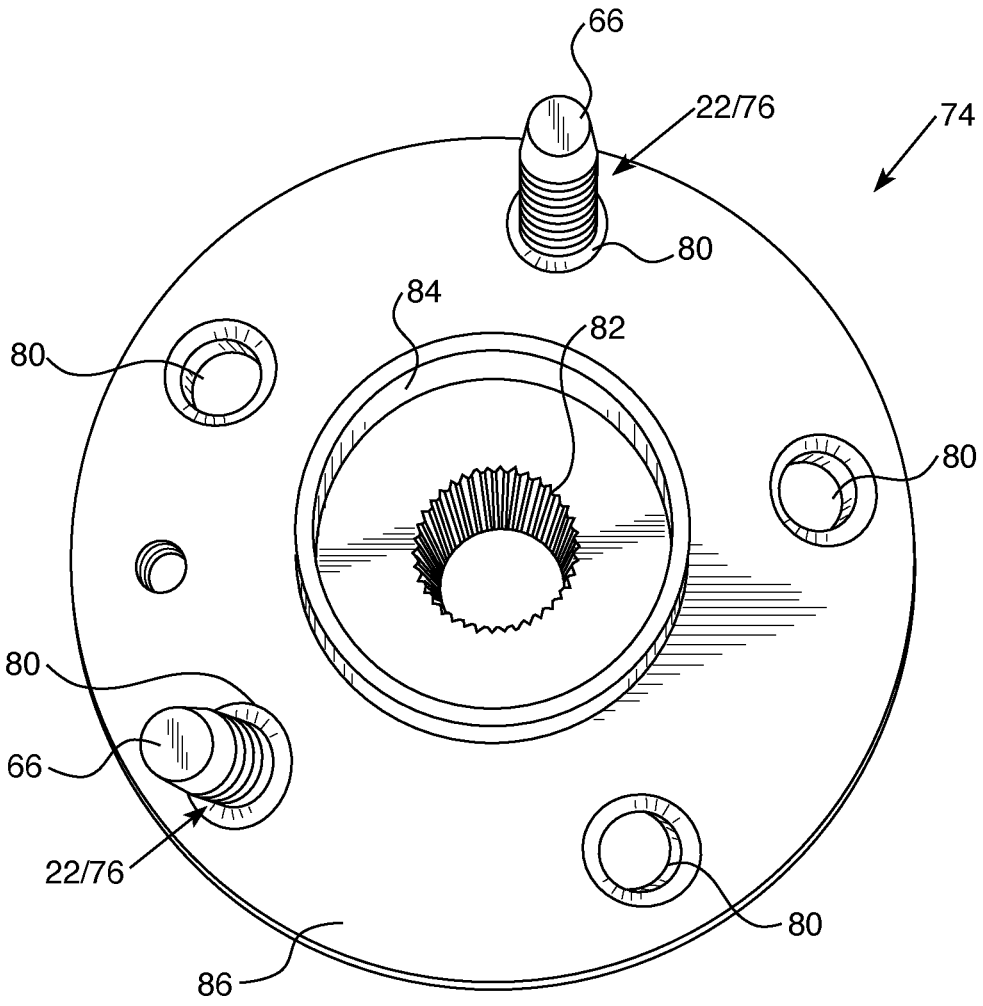
FIG. 15 is a top view of an exemplary hub bearing assembly.
Figure 16:
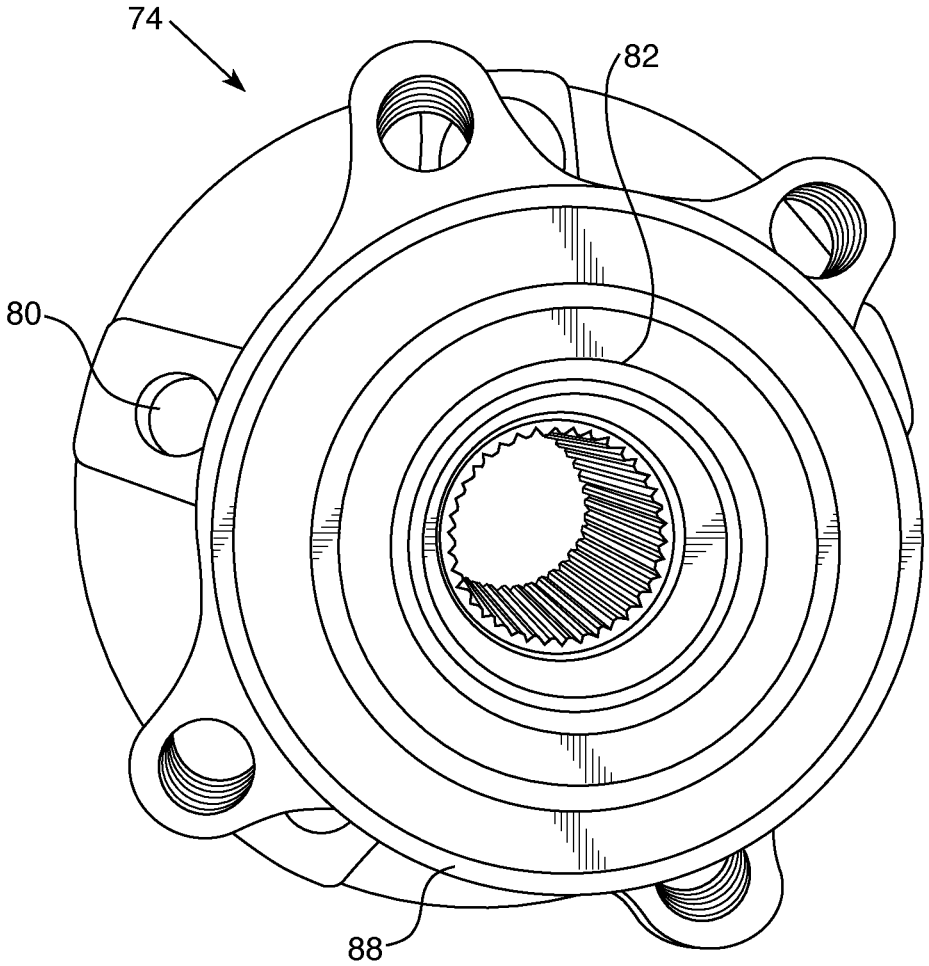
FIG. 16 is a bottom view of an exemplary hub bearing assembly.

As shown in FIGS. 15 and 16, hub bearing assembly 74 is comprised of a top side 86 and a bottom side 88. In one example, hub bearing assembly 74 has five threaded holes 80 through which lug nut bolts 76 normally pass, although other hub bearing assemblies may have different numbers of these holes. The threaded ends of lug nut bolts 76 emerge from the top side 86 of hub bearing assembly 74. Hub bearing assembly 74 has a tooth-geared hole 82 at the center of hub bearing 74, which is designed to engage the corresponding teeth 90 on drive shaft 78. In addition, one example of hub bearing 74 has a raised collar portion 84 that is approximately 1.5 inches in diameter and 0.3 inches high and is centered on the center of hub bearing assembly 74 and emerges from top side 86 of hub bearing assembly 74.

To remove a hub bearing assembly 74 from drive shaft 78, an individual will perform a number of steps. First, the wheel must be removed from the hub bearing assembly 74. Next, any connections (such as bolts, wires, cables, straps, etc.) that otherwise connect the hub bearing assembly to knuckle 48 and drive shaft 78 must be removed. In addition, lug nut bolts 76 are removed from hub bearing assembly 74. While at least two of the lug nut bolts 76 can be left in hub bearing assembly 74 to be used to draw hub bearing assembly 74 off of drive shaft 78, it has been found that it is preferable to replace lug nut bolts with bolts 22, which are stronger. The invention does not require this replacement, however, and lug nut bolts 76 can be used as bolts 22 and still fall within the scope of the invention. It is contemplated for a user to use at least three push rods 18 (but more or less can be used), so for a hub bearing assembly 74 that only has five lug nut bolts, only two bolts 22 may be used. If the hub bearing assembly 74 has six or more lug nut bolts, the user could use additional bolts 22 or push rods 18 as desired.

When ready, hub bearing assembly 74 will longer be blocked from being removed from knuckle 48 and drive shaft 78, except for any corrosion or buildup that may have occurred and that is causing hub bearing assembly 74 to be stuck onto drive shaft 78.

An embodiment of the extraction tool 10 is connected to hub bearing assembly 74. Given the number of components in the extraction tool 10, this connection can be made in a variety of ways depending on the preference of the user. One such exemplary way is described below for a hub bearing assembly 74 with five lug nut bolts 76, but those skilled in the art would recognize various alternative ways of connecting the extraction tool 10 to hub bearing assembly 74 depending on the preferences of the user and the number of lug nut bolts 76 for the particular hub bearing assembly 74 being removed.

As shown in FIG. 17, bottom plate 14 is slid onto the top side 86 of hub bearing assembly 74 such that the lower side 38 of bottom plate 14 faces the top side 86 of hub bearing assembly 74. The recessed portion 72 of bottom plate 14 fits into a collar portion 84 of hub bearing assembly 74, thereby centering bottom plate 14 over hub bearing assembly 74. The bottom plate 14 is rotationally aligned with hub bearing assembly 74 such that the bolts 22 emerging from the top side 86 of hub assembly 74 fit through at least some of the bottom plate bolt holes 50' in the bottom plate 14. Set screws 20 are then threaded through set screw holes 42 in bottom plate 14 (alternatively, they may already be threaded in the set screw holes 42 prior to bottom plate 14 engaging hub assembly 74). The set screws 20 are adjusted (such as by rotating a tool coupled to end 44 of set screws) to cause ends 46 of the set screws 20 to engage the surface 86 of hub bearing assembly 74, wherein further rotation of them facilitates making the bottom plate 14 and the top side 86 of hub hearing assembly 74 generally parallel to one another. Once the set screws 50 have been adjusted to maintain this parallel alignment, nuts are placed over the exposed ends of bolts 22 and tightened to firmly and rigidly connect bottom plate 14 to the hub bearing assembly 74.

As shown in FIG. 11, three push rods 18 are loosely inserted into top plate push rod holes 26 in the lower side 30 of top plate 12 such that the three push rods 18 are aligned to pass through bottom plate push rod holes 50 in bottom plate 14 and the remaining three holes 80 in hub bearing assembly 74. The three extending push rods 18 (along with the connected top plate 12) are inserted into bottom plate push rod holes 50 and the remaining three holes 80 in hub bearing assembly 74 until the push rod ends 54 of each push rod 18 engage the surface of knuckle 48. The push rods 18 are then rotated (thereby changing the respective lengths they extend from the bottom of top plate 12) until top plate 12 is roughly parallel to bottom plate 14 when the push rod ends 54 are in contact with knuckle 48. This parallel alignment is desirable because it will more evenly distribute the forces against knuckle 48 when the extraction tool 10 is used to remove hub bearing assembly 74. Perfect parallel alignment is not required, but the more parallel they are, the better extraction tool 10 will function.

Figure 5:
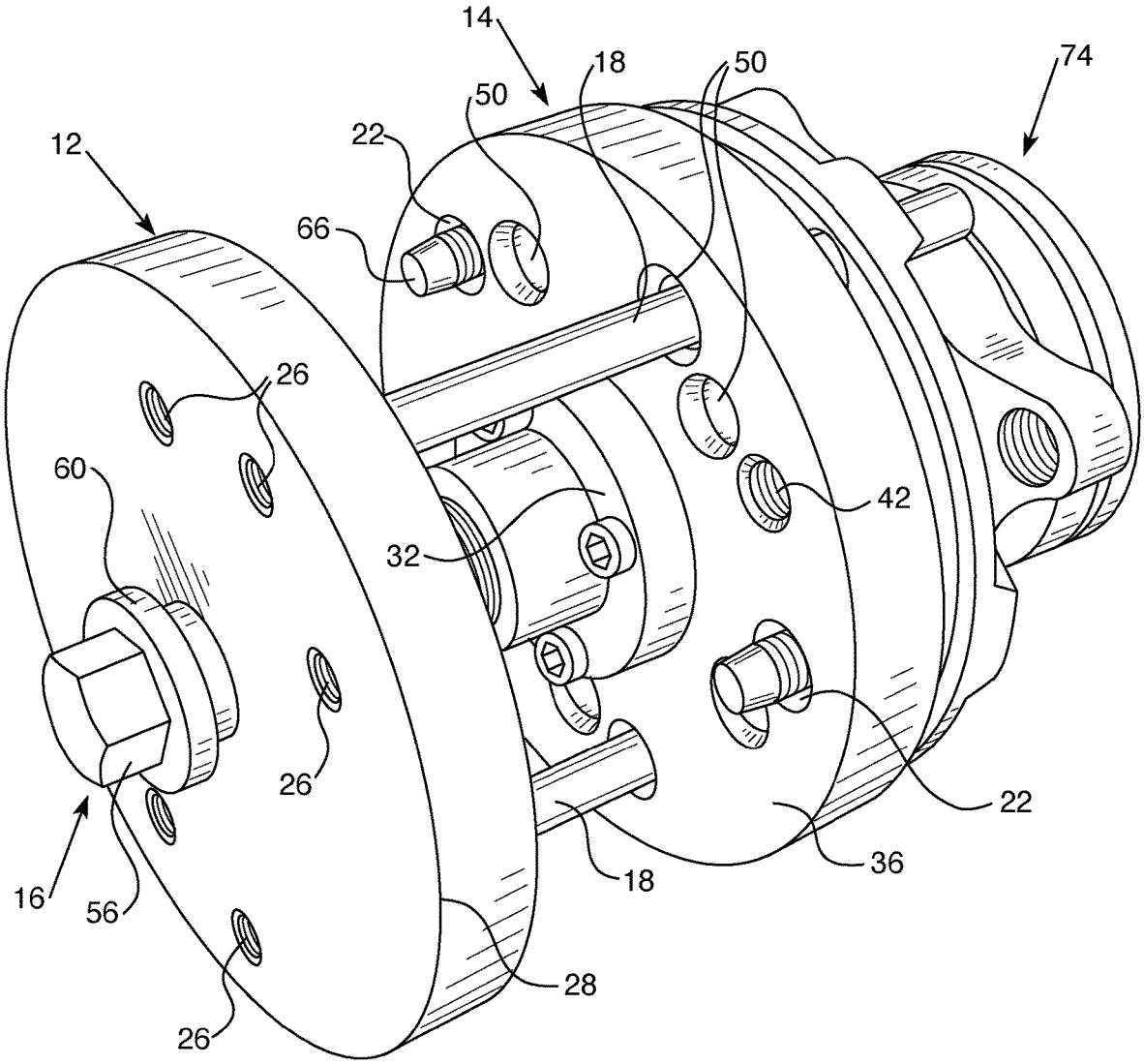
FIG. 5 is a side perspective view of an exemplary embodiment of the extraction tool inserted into a hub bearing assembly.
Figure 6:
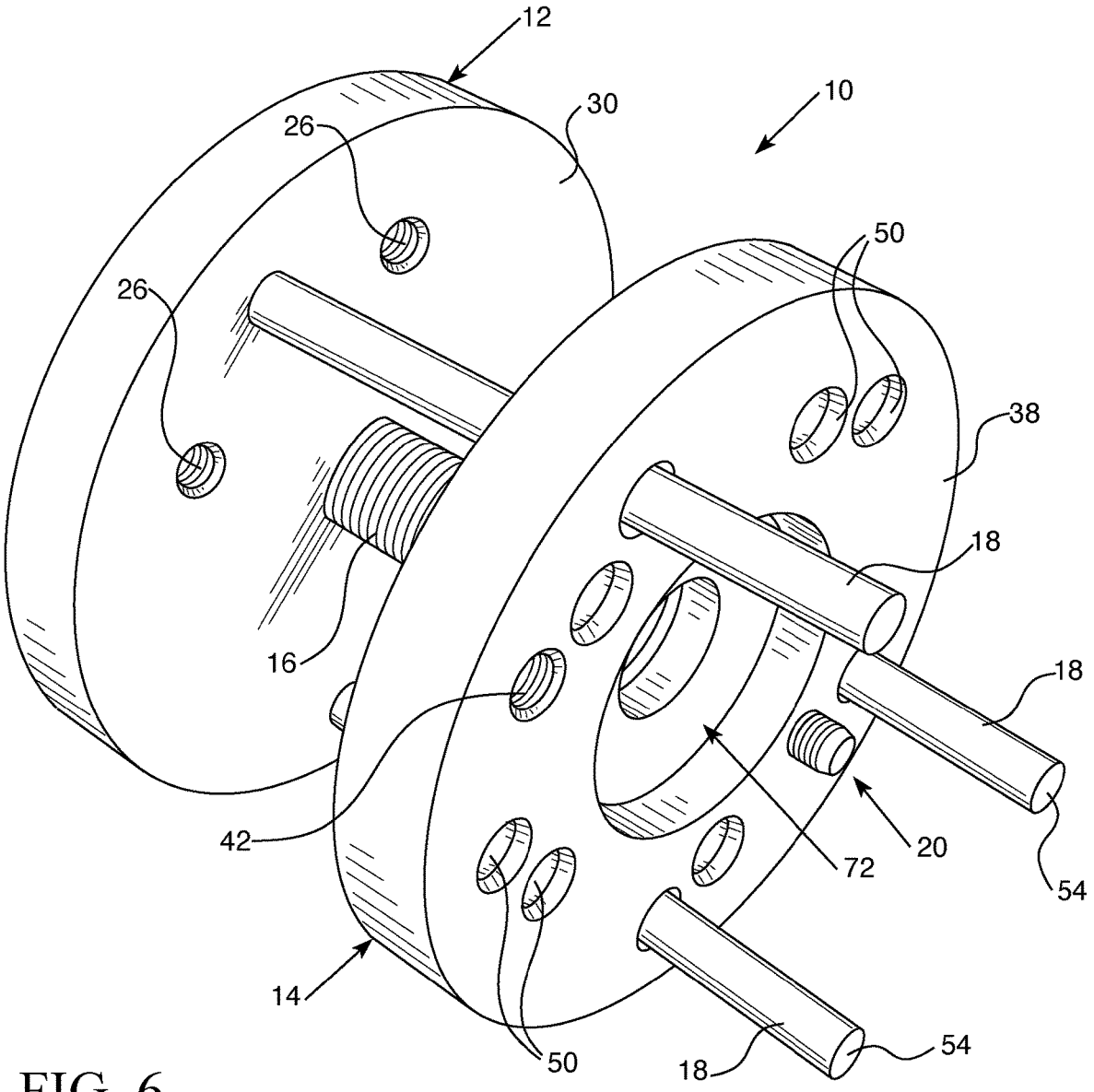
FIG. 6 is a side perspective view of an exemplary embodiment of the extraction tool.
Figure 7:
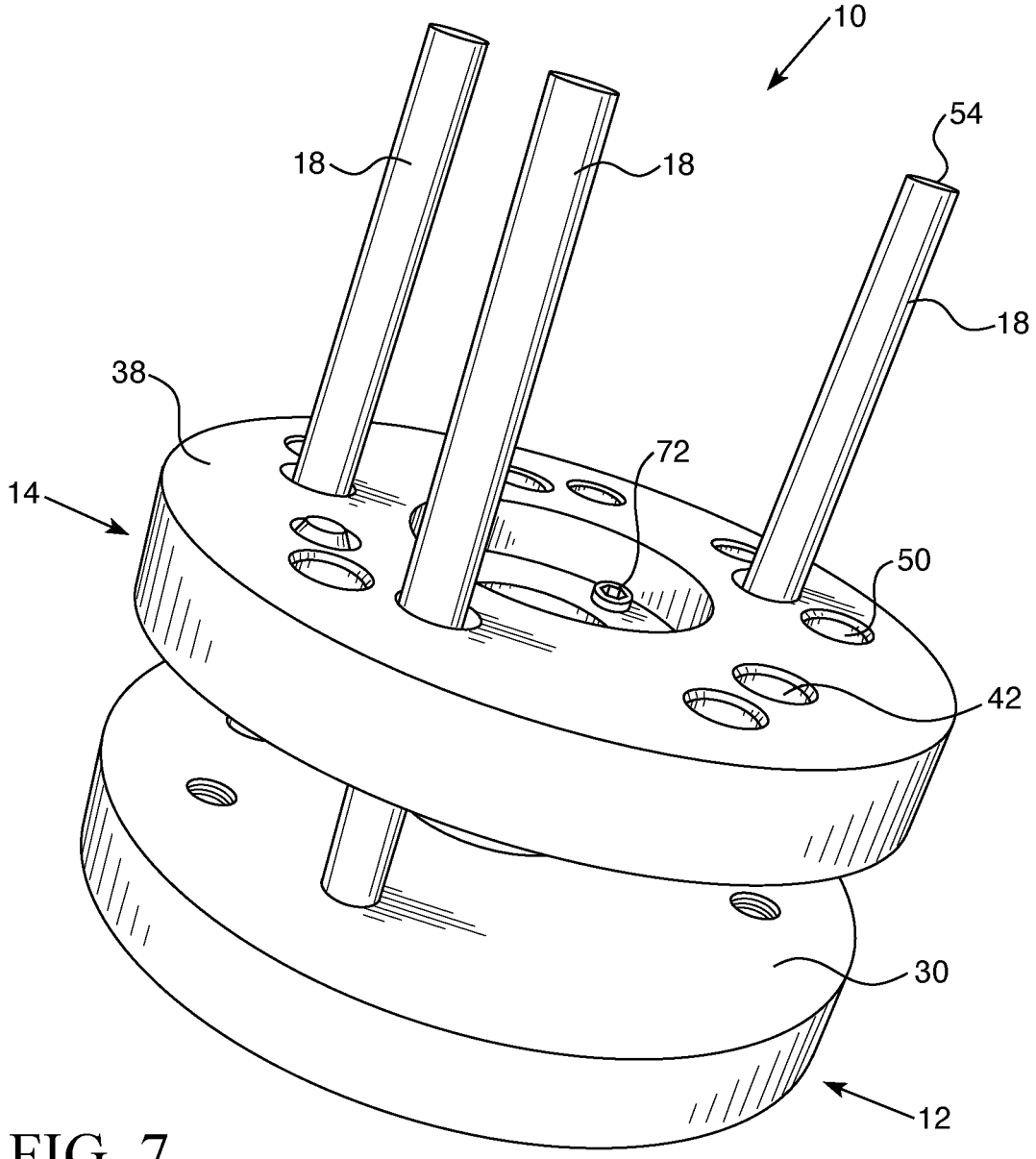
FIG. 7 is another side perspective view of an exemplary embodiment of the extraction tool.

As shown in FIG. 5, end 58 of the force rod 16 is inserted through the top plate force rod hole 24 and threaded into the bottom plate force rod hole 40 via the collar 32 in the bottom plate 14. The force rod 16 can be rotated until the collar 60 engages the top plate 12. Depending on conditions, this rotation may be done by hand or a tool (such as a wrench).

At this point, the extraction tool 10 is rigidly coupled to hub bearing assembly 74, and hub bearing assembly 74 may be removed from drive shaft 78 by further rotating the force rod 16. Given the forces that likely will be required to rotate the force rod 16 at this point, a tool (such as a wrench or whatever the appropriate tool is to couple to the head end 56 of force rod 16) can be used.

Rotating the force rod 16 causes bottom plate 14 to be drawn towards top plate 12 because the push rods 18 prevent top plate 12 from being drawn towards knuckle 48. Because bottom plate 14 is bolted to hub bearing assembly 74, hub bearing assembly 74 will also be drawn towards top plate 12, away from knuckle 48, and off drive shaft 78. Eventually, as the force rod 16 continues to rotate, hub bearing assembly 74 will entirely come off of drive shaft 78 or will loosen to such an extent that hub bearing assembly 74 can simply be pulled directly off of drive shaft 78 by hand.

The generally parallel alignment of the three components: top plate 12, bottom plate 14, and hub bearing assembly 74 means that the forces exerted against hub bearing assembly 74 by rotation of the force rod 16 will be evenly distributed and cause hub bearing assembly 74 to move in a direction parallel to the axis of drive shaft 78. This design significantly reduces the torque placed on hub bearing assembly 74 in comparison to other conventional methods of removing a stuck hub bearing assembly.

It is understood that the dimensions disclosed herein are exemplary only and that other dimensions for any of the components of the extraction tool 10 can be used to meet desired design criteria.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. An extraction tool, comprising:

a top plate having a smooth-bored top plate force rod hole and a plurality of threaded top plate push rod holes;

a bottom plate having a threaded bottom plate force rod hole, a plurality of smooth-bored bottom plate push rod holes, a plurality of threaded set screw holes and a plurality of smooth-bored bottom plate bolt holes, wherein at least one individual threaded set screw hole is adjacent an individual smooth-bored push rod hole;

a force rod configured to slidably engage the smooth-bored top plate force rod hole and threadingly engage the threaded bottom plate force rod hole; and a plurality of push rods, each individual push rod configured to threadingly engage an individual threaded top plate push rod hole of the plurality of threaded top plate push rod holes and slidably engage an individual smooth-bored bottom plate push rod hole of the plurality of smooth-bored bottom plate push rod holes;

wherein when the bottom plate is placed over the hub bearing assembly:

any one or combination of the bottom plate bolt holes align with any one or combination of lug nut holes of a hub bearing assembly; and each individual push rod abuts directly against a knuckle.

2. The extraction tool of claim 1, further comprising a plurality of set screws.

3. The extraction tool of claim 1, wherein any one or combination of the bottom plate bolt holes are configured to slidably receive a lug nut bolt.

4. The extraction tool of claim 3, further comprising a nut to threadingly engage the lug nut bolt.

5. The extraction tool of claim 1, further comprising a bolt, wherein any one or combination of the bottom plate bolt holes are configured to slidably receive the bolt.

6. The extraction tool of claim 5, further comprising a nut to threadingly engage the bolt.

7. The extraction tool of claim 1, wherein any one or combination of the bottom plate push rod holes align with any one or combination of lug nut holes of the hub bearing assembly when the bottom plate is placed over the hub bearing assembly.

8. The extraction tool of claim 7, wherein an individual push rod of the plurality of push rods is configured to pass through an individual bottom plate push rod hole of the plurality of bottom plate push rod holes and an individual lug nut hole of the lug nut holes of the hub bearing assembly.

9. The extraction tool of claim 1, wherein the bottom plate further comprises a collar.

10. The extraction tool of claim 1, wherein the bottom plate further comprises a recess.

11. A method of extracting a hub bearing assembly from a knuckle, the method comprising:

without removing an axle, a constant velocity joint, and/or a knuckle from the hub bearing assembly, placing a bottom plate against a top surface of the hub bearing assembly;

securing the bottom plate to the hub bearing assembly;

threadingly securing a plurality of push rods to a top plate;

placing the top plate over the bottom plate so that the plurality of push rods pass through the bottom plate, pass through the hub bearing assembly, and abut directly against the knuckle;

sliding a force rod though the top plate and threadingly engaging the force rod with the bottom plate; and rotating the force rod to advance the bottom plate and the hub bearing assembly towards the top plate.

12. The method of claim 11, further comprising:

adjusting the plurality of push rods to adjust the orientation of the top plate relative to the bottom plate.

13. The method of claim 12, wherein adjusting the plurality of push rods causes the top plate to be parallel with the bottom plate.

14. The method of claim 11, further comprising:

adjusting set screws within the bottom plate to adjust the orientation of the bottom plate relative to the hub bearing assembly.

15. The method of claim 14, wherein adjusting the set screws within the bottom plate causes the bottom plate to be parallel with a top surface of the hub bearing assembly.

* * * * *